US007591648B2

(12) United States Patent
Mosiewicz

(10) Patent No.: US 7,591,648 B2
(45) Date of Patent: Sep. 22, 2009

(54) BURNER APPARATUS

(75) Inventor: Pawel Mosiewicz, Muncie, IN (US)

(73) Assignee: Maxon Corporation, Muncie, IN (US)

( * ) Notice: Subject to any disclaimer, the term of this patent is extended or adjusted under 35 U.S.C. 154(b) by 0 days.

(21) Appl. No.: 11/854,644

(22) Filed: Sep. 13, 2007

(65) Prior Publication Data

US 2009/0075223 A1 Mar. 19, 2009

(51) Int. Cl.
*F23D 14/70* (2006.01)
*F23D 15/02* (2006.01)

(52) U.S. Cl. ..... 431/351; 431/350; 431/354; 431/278; 432/222; 432/223; 110/260; 110/265

(58) Field of Classification Search ..... 431/351–354, 431/378; 432/222–223; 110/260, 261, 265
See application file for complete search history.

(56) References Cited

U.S. PATENT DOCUMENTS 3,574,508 A 4/1971 Rothhaar
3,630,499 A * 12/1971 Kramer, Jr. ..... 432/222
3,706,446 A * 12/1972 Briggs ..... 432/224
3,881,863 A 5/1975 Creuz
4,573,907 A * 3/1986 Coppin et al. ..... 431/351
4,673,350 A 6/1987 Collier
4,963,089 A 10/1990 Spielman
5,049,066 A * 9/1991 Kaiya et al. ..... 431/352
5,055,032 A 10/1991 Altemark
5,131,836 A * 7/1992 Coppin ..... 431/12
5,520,537 A 5/1996 Taylor
6,394,795 B2 5/2002 Fayerman et al.
6,921,261 B2 7/2005 Perry
2005/0132941 A1 6/2005 Taylor

OTHER PUBLICATIONS

International Search Report dated Mar. 19, 2009, for International Application No. PCT/US2008/073710.

* cited by examiner

*Primary Examiner*—Steven B McAllister
*Assistant Examiner*—Nikhil Mashruwala
(74) *Attorney, Agent, or Firm*—Barnes & Thornburg LLP

(57) ABSTRACT

A burner assembly includes a fuel nozzle and an air-fuel mixing cone coupled to the fuel nozzle. Fuel is discharged from the fuel nozzle into a mixing chamber formed in the air-fuel mixing cone. Air passes into the mixing chamber through openings formed in the air-fuel mixing chamber and mixes with fuel to form a combustible air-fuel mixture in the air-fuel mixing chamber.

21 Claims, 12 Drawing Sheets

BURNER APPARATUS

BACKGROUND

The present disclosure relates to burner assemblies, and particularly to air-fuel burner assemblies. More particularly, the present disclosure relates to internally fired industrial gas burners.

SUMMARY

A burner assembly in accordance with the present disclosure includes a fuel nozzle and an air-fuel mixing cone coupled to the fuel nozzle. A mixing chamber provided in the air-fuel mixing cone is configured to receive and mix fuel discharged by the fuel nozzle with pressurized air extant in a nearby air plenum to generate a combustible air-fuel mixture. This mixture can be ignited to produce a flame.

The air-fuel mixing cone includes an inner end having an opening receiving the fuel nozzle, an outer end having a downstream combustion-discharge opening, and a funnel-shaped side wall extending between the inner and outer ends. The air-fuel mixing cone also includes an air-admission portal comprising various openings formed in the funnel-shaped size wall to conduct pressurized combustion air extant in the air plenum into the mixing chamber to mix with fuel discharged into the mixing chamber by the fuel nozzle.

In illustrative embodiments, the air-admission portal is formed in the funnel-shaped side wall and configured to decrease progressively in effective size (i.e., total open area) along a length of the funnel-shaped wall as the distance away from the fuel nozzle increases. This progressive decrease in the total open area of the openings formed in the funnel-shaped side wall to define the air-admission portal causes a greater volume of pressurized combustion air to pass from the air plenum through an "upstream" portion of the air-admission portal into a part of the mixing chamber located near to the fuel nozzle. This progressive decrease also causes a lesser volume of pressurized combustion air to pass from the air plenum through a "downstream" portion of the air-admission portal into other parts of the mixing chamber located farther away from the fuel nozzle.

In illustrative embodiments, the funnel-shaped side wall includes a perforated inlet section located near the fuel nozzle and formed to include the air-admission portal. A cold-temperature flame-quenching zone is formed in the perforated inlet section and this zone "contains" a first-stage air-and-fuel mixture characterized by a relatively low nitrogen oxide (NOx) content and a relatively high hydrocarbon (HC) content and a relatively high carbon monoxide (CO) content.

The funnel-shaped side wall also includes a "downstream" unperforated outlet section located between the perforated inlet section and the downstream combustion-discharge opening. A high-temperature emission-reduction burnout zone is formed in the unperforated outlet section to burn CO and HC included in the first-stage air-and-fuel mixture flowing from the cold-temperature flame-quenching zone of the perforated inlet section into the high-temperature emission-reduction burnout zone. In this emission-reduction burnout zone, CO and unburned HC are burned to produce a second-stage air-and-fuel mixture characterized by a low NOx content, a low CO content, and a low hydrocarbon (HC) content. No additional combustion air is added to the second-stage air-and-fuel mixture flowing through the high-temperature emission-reduction burnout zone formed in the unperforated outlet section of the funnel-shaped side wall. The absence of air at this stage raises the temperature and lowers CO and HC content of the air-and-fuel mixture flowing in the burnout zone to produce a second-stage air-and-fuel mixture in accordance with the present disclosure.

An igniter is used to ignite the combustible air-and-fuel mixture created in the mixing chamber to produce a flame. In illustrative embodiments, about 80 to 90 percent of the air needed for combustion is admitted into the mixing chamber through the air-admission portal that is configured to have a progressively smaller effective "open area" or size as the air-admission portal extends away from the fuel nozzle and along the length of the funnel-shaped side wall. In such embodiments, about 10 to 20 percent of the air needed for combustion is discharged into a downstream combustion zone provided in a burner housing configured to receive the second-stage air-and-fuel mixture exiting through the downstream combustion-discharge opening formed in the air-fuel mixing cone.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
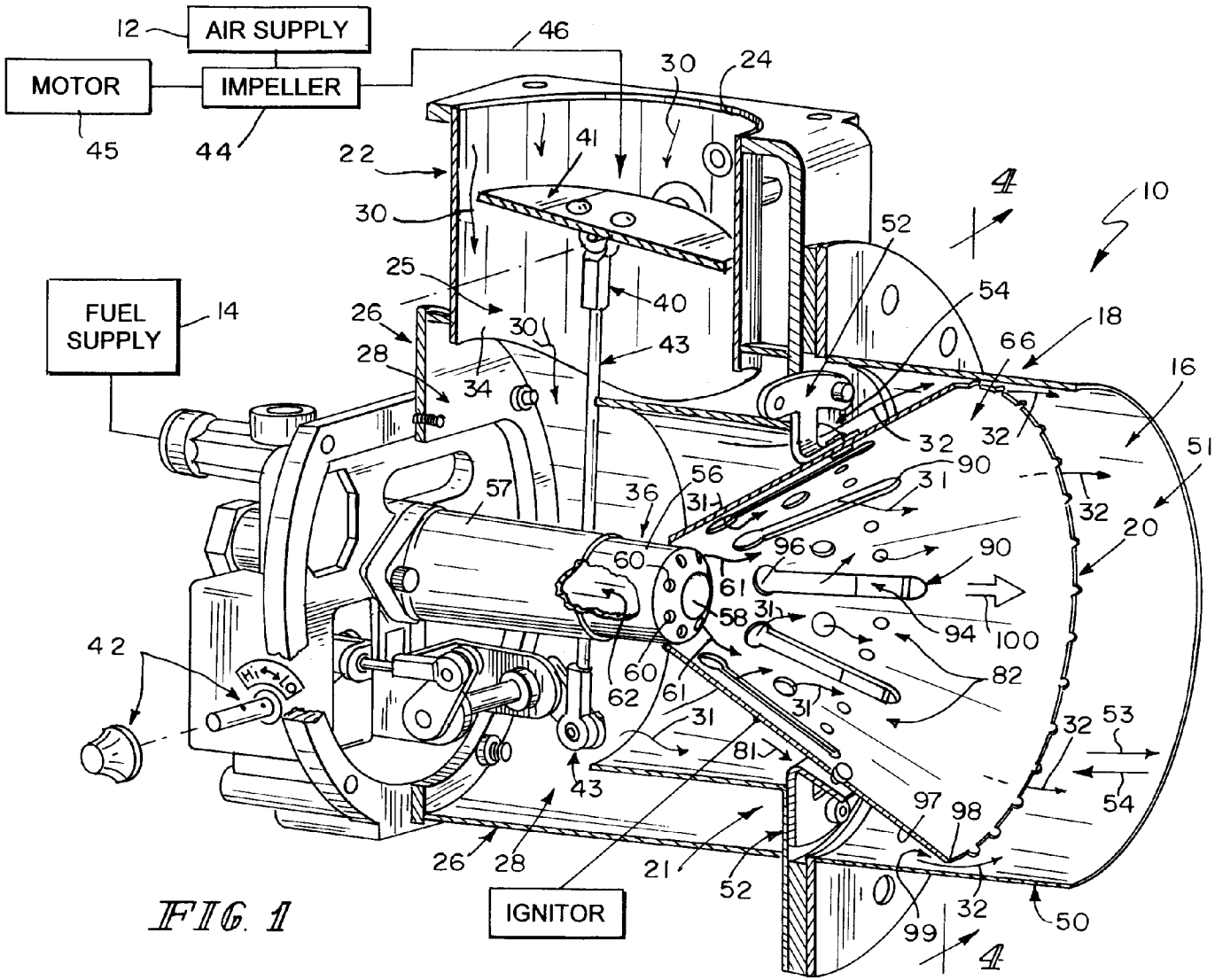
FIG. 1 is a perspective view of an air-fuel burner, with portions broken away, showing a fuel nozzle including a cylindrical shell formed to include eight fuel-discharge ports and a fuel-transport passageway conducting fuel from a fuel supply to the fuel-discharge ports and an air-fuel mixing cone in accordance with the present disclosure mounted in a burner housing to mate with the fuel nozzle and configured to mix incoming fuel discharged by the fuel nozzle into a "mixing" chamber formed in the cone with "primary combustion" air discharged into the mixing chamber through various air-admission slots and ports formed in a perforated inlet section of the cone to produce a combustible air-fuel mixture in the mixing chamber of the air-fuel mixing cone.
Figure 9:
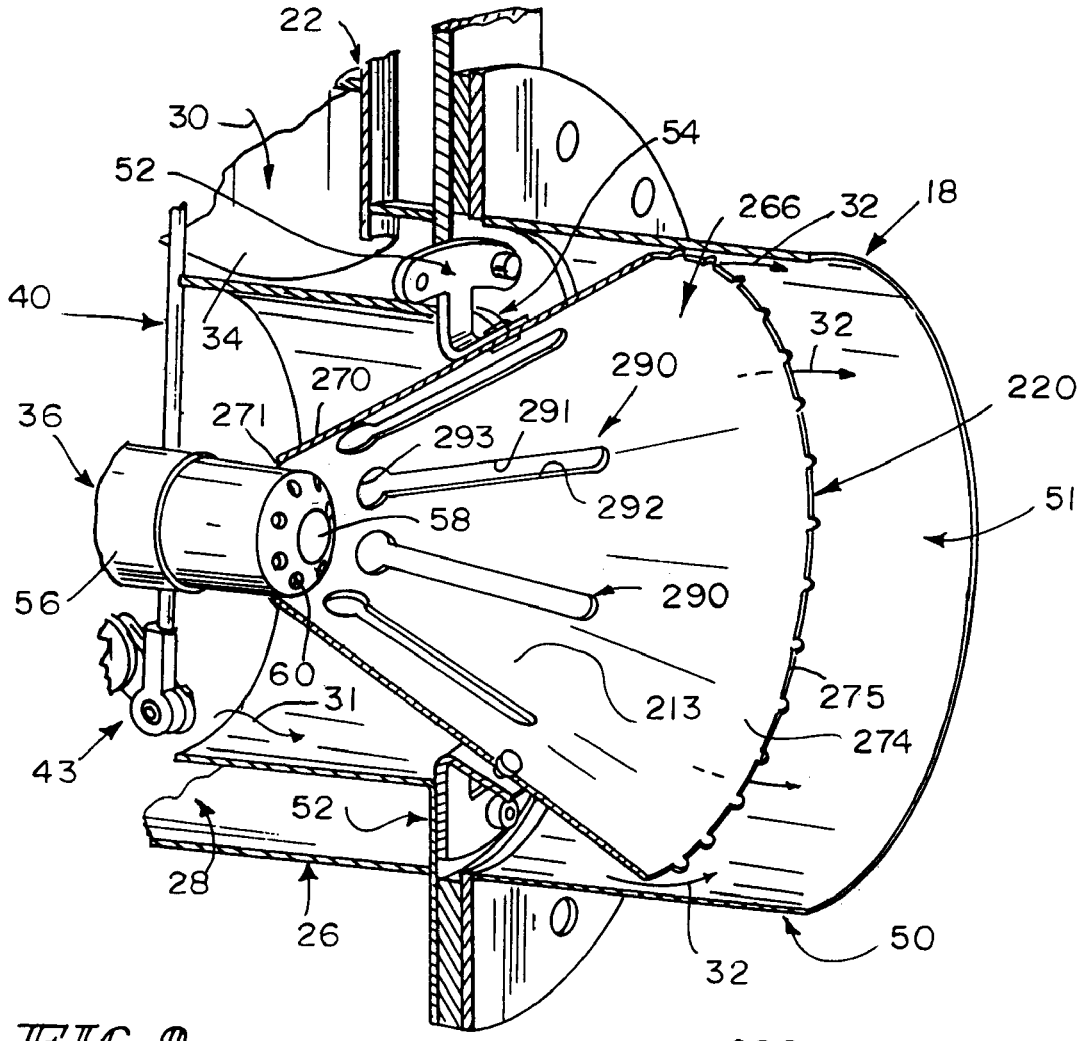
FIGS. 9 and 10 show an air-fuel mixing cone in accordance with a second embodiment of the present disclosure.
Figure 10:
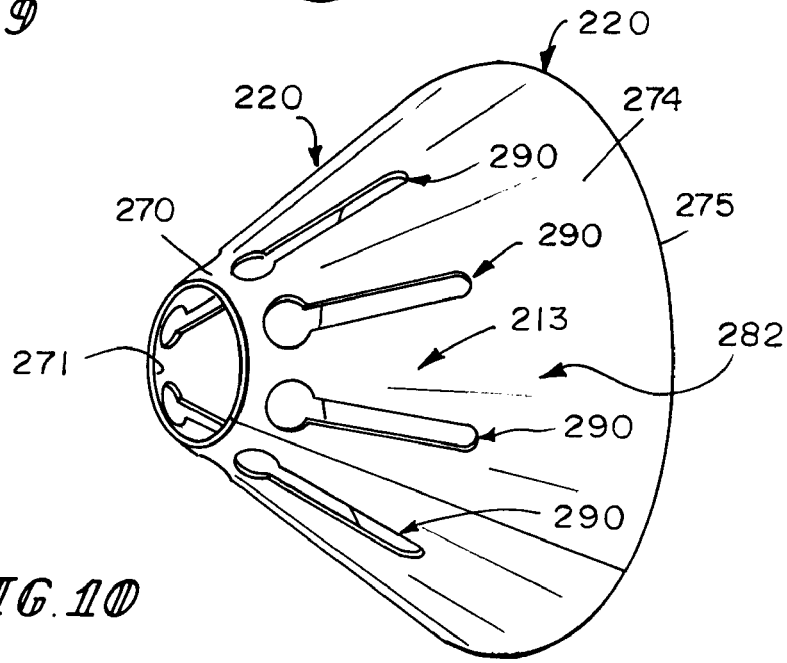
Figure 11:
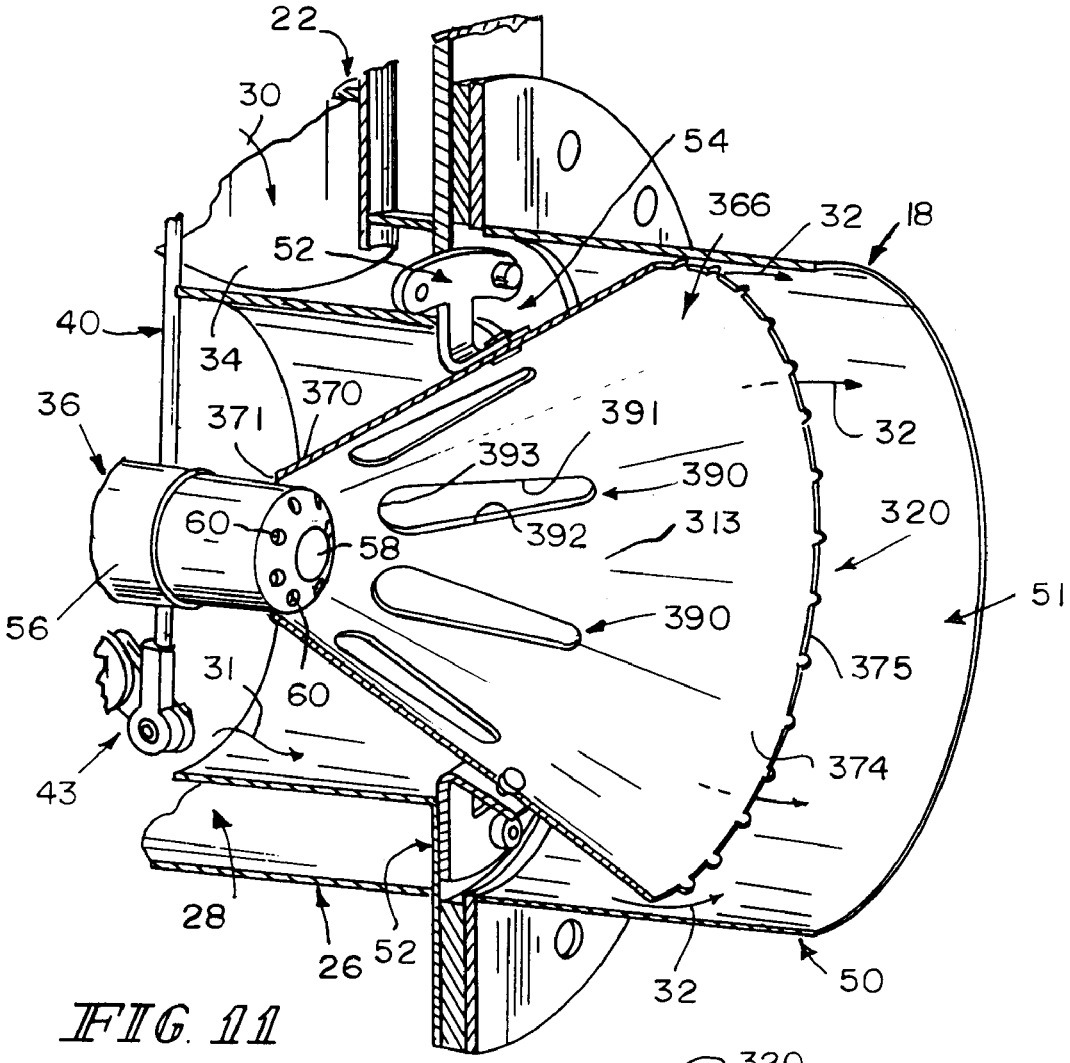
FIGS. 11 and 12 show an air-fuel mixing cone in accordance with a third embodiment of the present disclosure.
Figure 12:
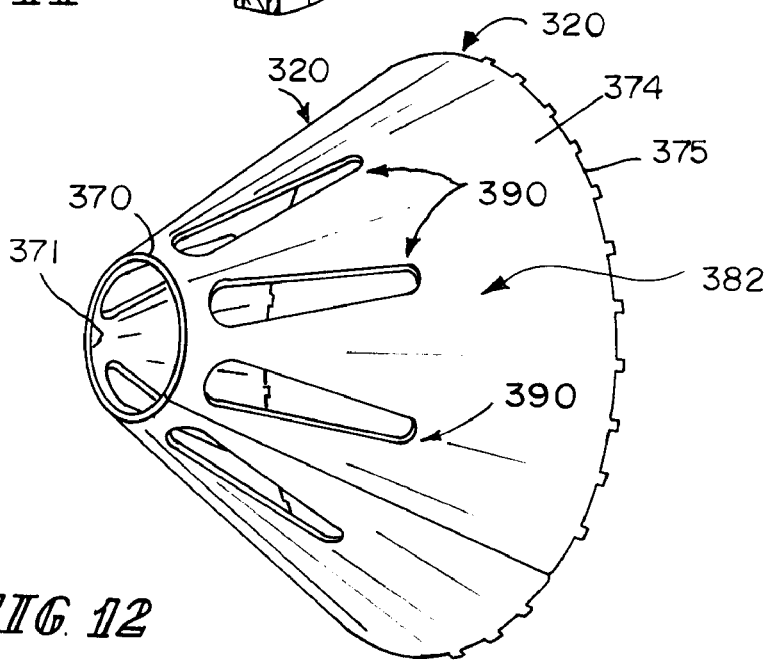
Figure 13:
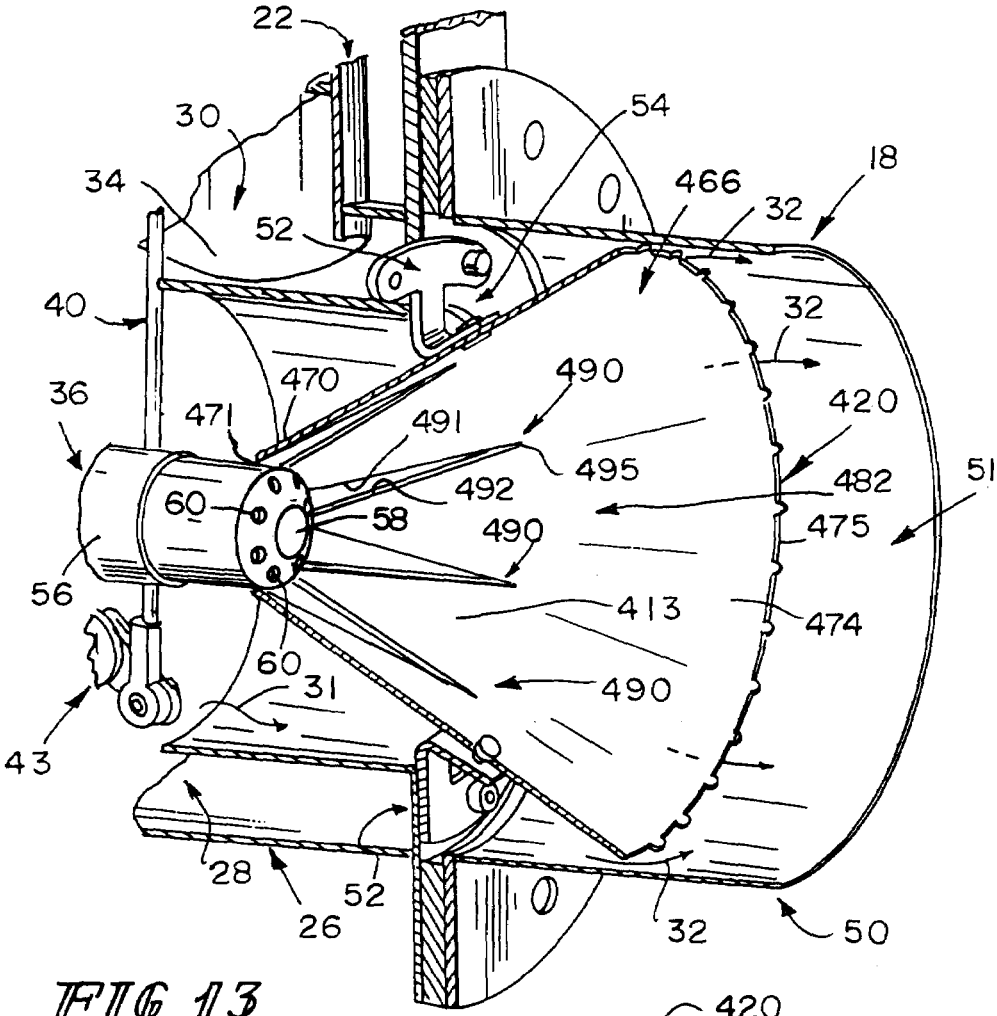
FIGS. 13 and 14 show an air-fuel mixing cone in accordance with a fourth embodiment of the present disclosure.
Figure 14:
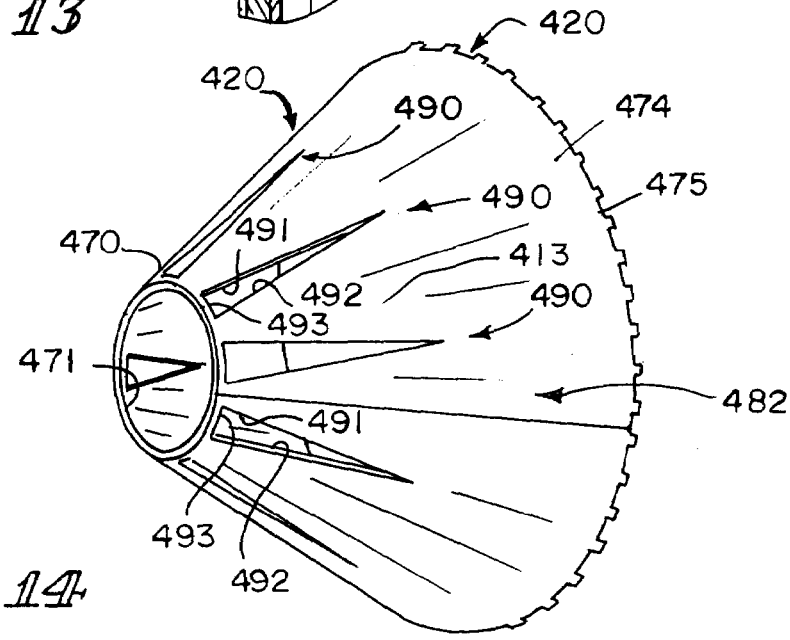
Figure 15:
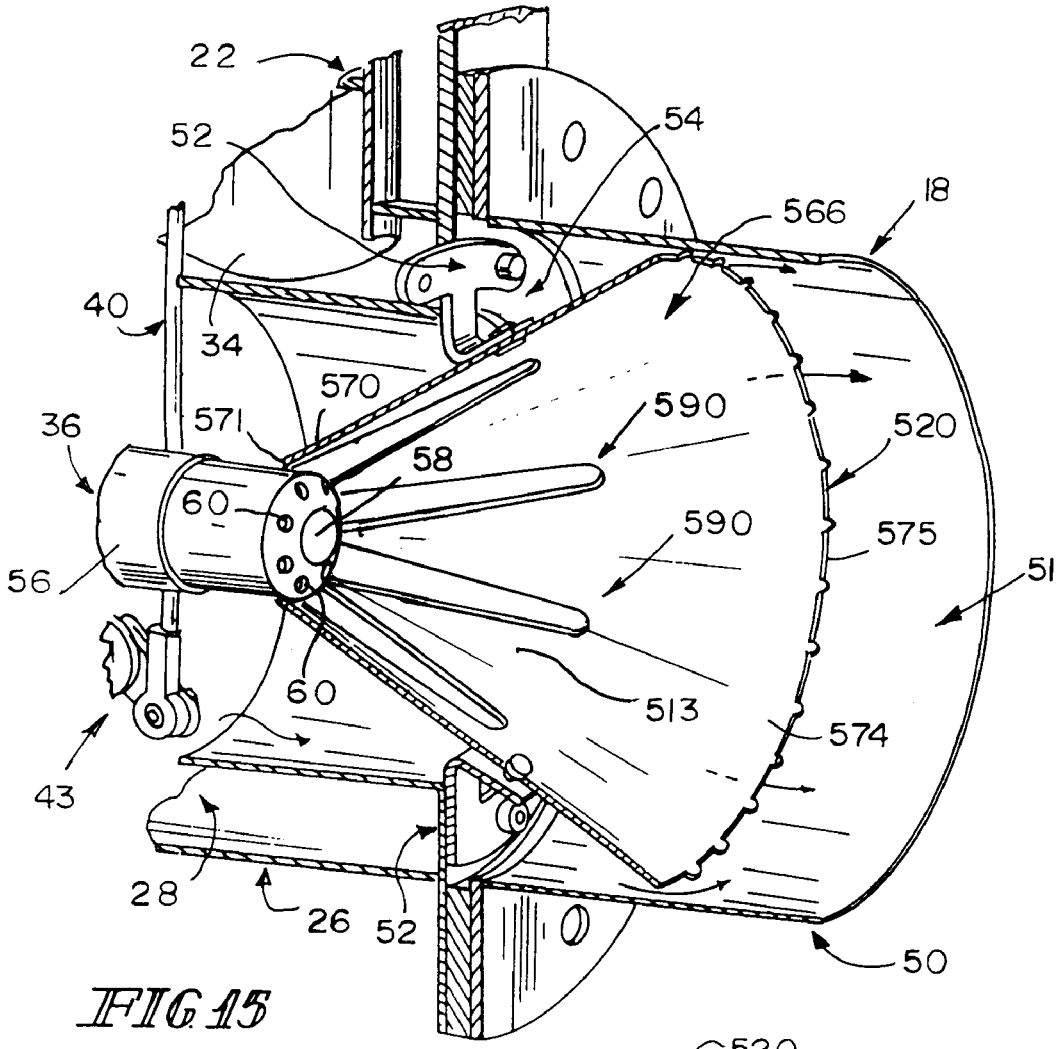
FIGS. 15 and 16 show an air-fuel mixing cone in accordance with a fifth embodiment of the present disclosure.
Figure 16:
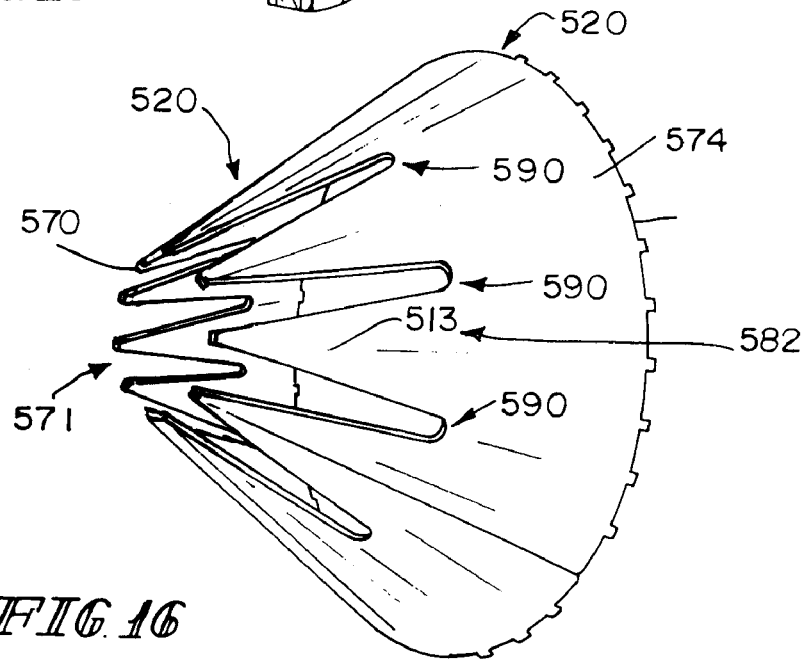

An illustrative burner assembly 10 for combining air from an air supply 12 and fuel from a fuel supply 14 to produce a flame (not shown) in a flame chamber 16 in a burner housing 18 is shown in FIG. 1. An air-fuel mixing cone 20 in accordance with the represent disclosure is shown illustratively in FIGS. 1 and 3-7 and diagrammatically in FIG. 2. A second illustrative air-fuel mixing cone 220 is shown in FIGS. 9-10. A third illustrative air-fuel mixing cone 320 is shown in FIGS. 11-12. A fourth illustrative air-fuel mixing cone 420 is shown in FIGS. 13-14. A fifth illustrative air-fuel mixing cone is shown in FIGS. 15-16.

Each of air-fuel mixing cones 20, 220, 320, 420, and 520 is configured in accordance with the present disclosure to regulate flow of combustion air from air supply 12 into a mixing chamber containing fuel from fuel supply 14. Each cone is formed to add a lot of combustion air into an upstream region of the mixing chamber near the fuel nozzle, then progressively decrease the amount of combustion air added into the mixing chamber as distance from the fuel nozzle increases, and finally block admission of any combustion air into a downstream region of the mixing chamber. By managing admission of combustion air in accordance with the present disclosure, it is possible to discharge from the mixing chambers provided in air-fuel mixing cones 20, 220, 320, 420, and 520 an air-fuel mixture 102 characterized by a low nitrogen oxide (NOx) content, a low carbon monoxide (CO) content, and a low hydrocarbon (HC) content as suggested in FIG. 2.

As shown in FIG. 1, burner assembly 10 includes an air inlet duct 22 formed to include an air intake opening 24, an air plenum 26 formed to include an air plenum chamber 28 arranged to receive combustion air 30 discharged through an air exhaust opening 34 formed in air inlet duct 22, and a fuel nozzle 36 coupled to fuel supply 14 via a conduit 38 and arranged to extend into air plenum chamber 28 of air plenum 26 to mate with air-fuel mixing cone 20. Air inlet duct 22 includes an air-conducting passageway 25 extending from air intake opening 24 to air exhaust opening 34 as suggested in FIG. 1. An air flow regulator 40 comprising an air intake valve 41, an air intake valve controller 42, and a valve-mover linkage 43 interconnecting air intake valve 41 and air intake valve controller 42 is coupled to burner housing 18 to regulate the flow of combustion air 30 discharged into air plenum chamber 28. Valve-mover linkage 43 is also coupled to a fuel intake valve 31 (not shown) associated with conduit 38 and a fuel linkage 33 as suggested in FIG. 1. Air intake valve 41 and fuel intake valve 31 are linked via valve-mover linkage 43 and cooperate to regulate flow of combustion air 30 discharged into air plenum chamber 28 and the flow of fuel into fuel nozzle 36. An impeller 44 turned by a motor 45 and located in an airflow conduit 46 interconnecting air supply 12 and air intake opening 24 of air inlet duct 22 is used to discharge combustion air 30 into air plenum chamber 28 via air inlet duct 22.

Burner housing 18 also includes a burner discharge sleeve 50 formed to include an interior region 51 and coupled to air plenum 26 as shown, for example, in FIGS. 1, 9, 11, 13, and 15. A cone support mount 52 is included in burner housing 18 and used to support air-fuel mixing cone 20 partly in air plenum chamber 28 and partly in interior region 51 of burner discharge sleeve 50. It is within the scope of this disclosure to adjust the position of air-fuel mixing cone 20 in directions 53 or 54 and relative to air plenum 26 and burner discharge sleeve 50 as needed. In an illustrative embodiment, cone support mount 52 is formed to include air-flow passageways 54 interconnecting air plenum chamber 28 and interior region 51 in fluid communication.

Figure 4:
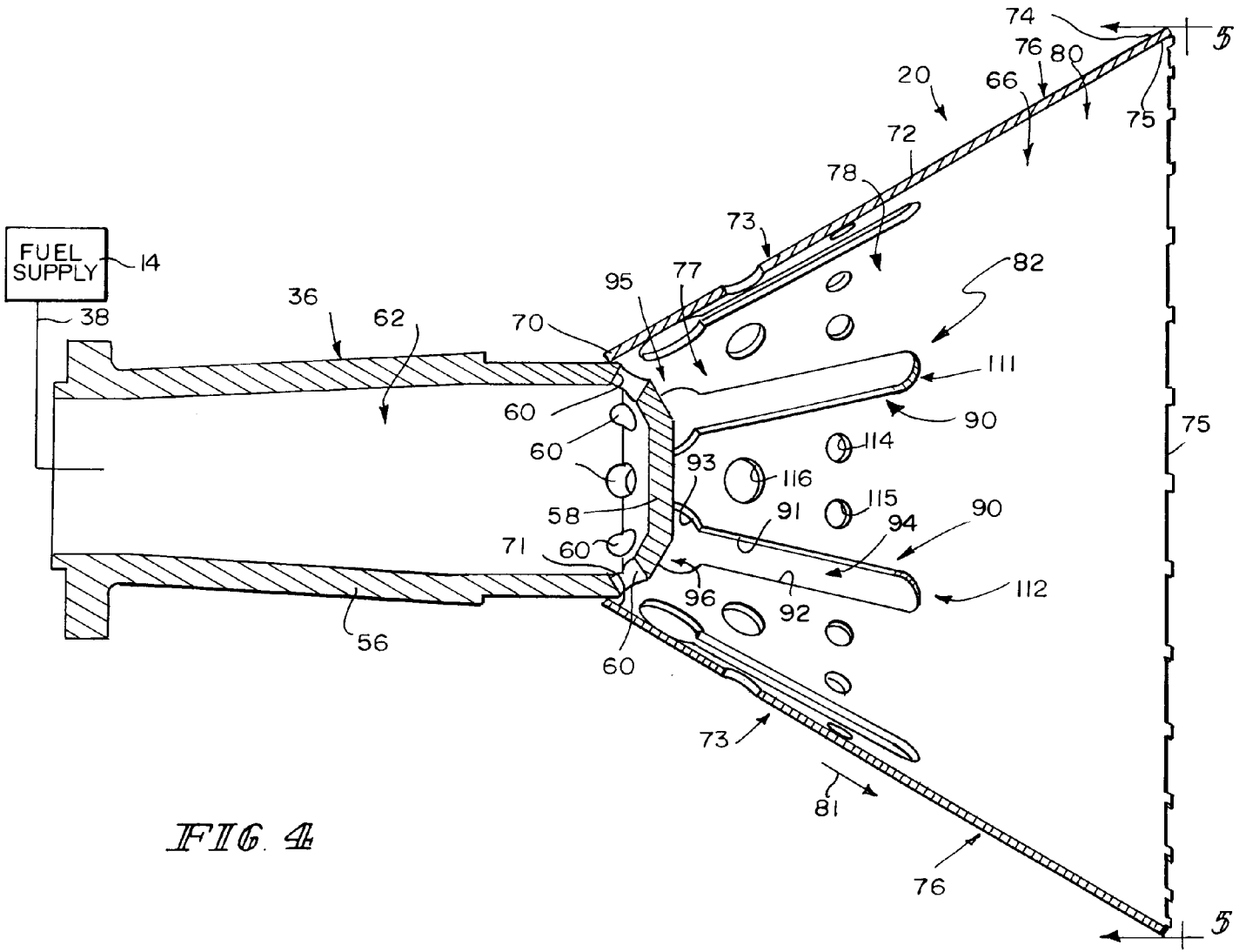
FIG. 4 is an enlarged sectional view taken along line 4-4 of FIG. 1 showing the air-fuel mixing cone mounted on a downstream end of the fuel nozzle and showing formation of the fuel nozzle to include a fuel-transport passageway leading to several fuel-discharge ports opening into the mixing chamber formed in the air-fuel mixing cone.
Figure 5:
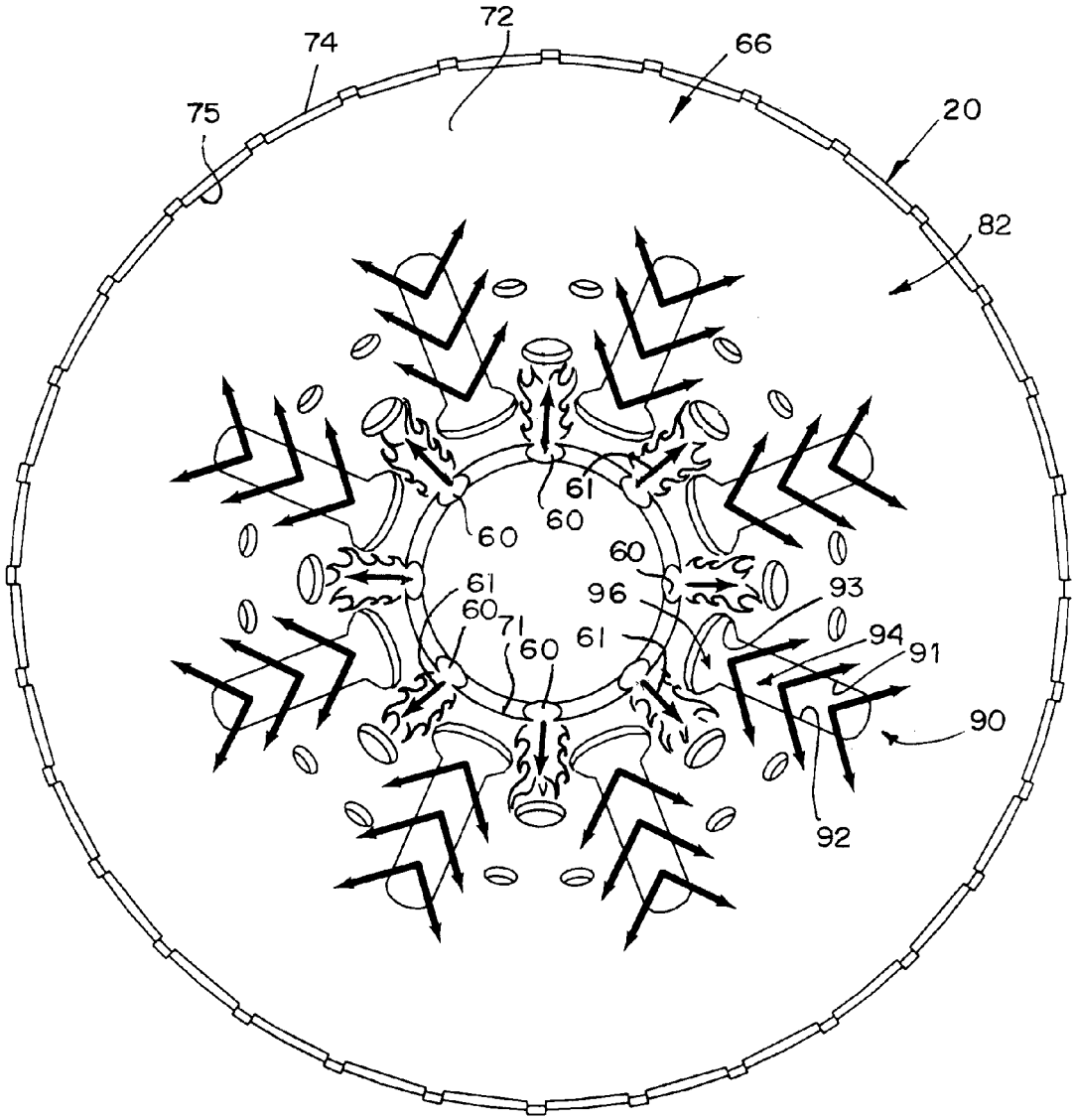
FIG. 5 is an elevation view taken generally along line 5-5 of FIG. 4 showing eight circumferentially spaced-apart fuel-discharge ports formed in the fuel nozzle, eight "keyhole-shaped" air-admission slots formed in the perforated inlet section of the cone, and eight sets of air-admission ports also formed in the perforated inlet section of the cone and diagrammatically showing some air and gas flow into the mixing chamber formed in the cone during "low-fire" conditions.
Figure 6:
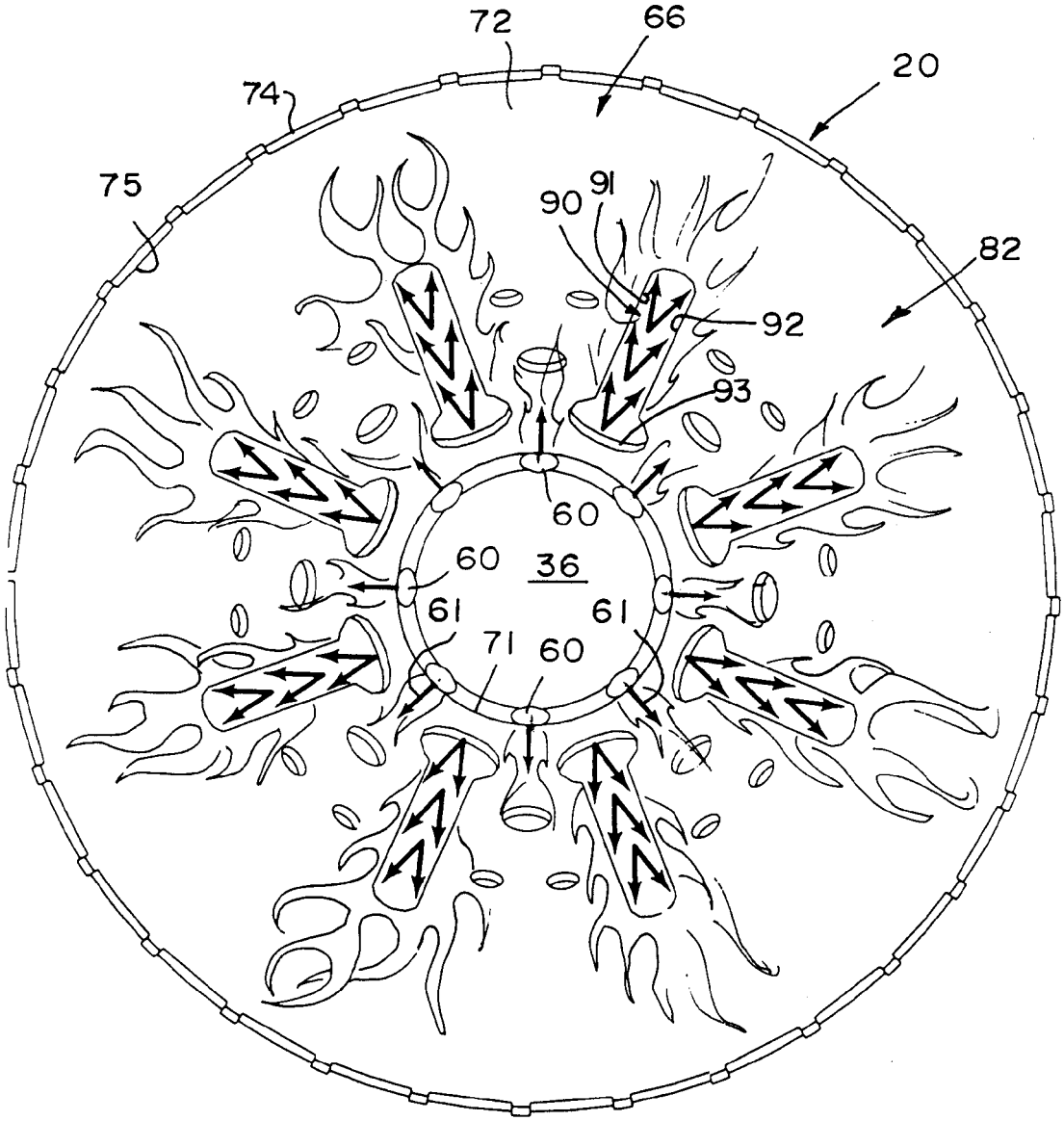
FIG. 6 is an elevation view similar to FIG. 5 diagrammatically showing relatively greater air and gas flow into the mixing chamber formed in the cone during "mid-fire" conditions.
Figure 7:
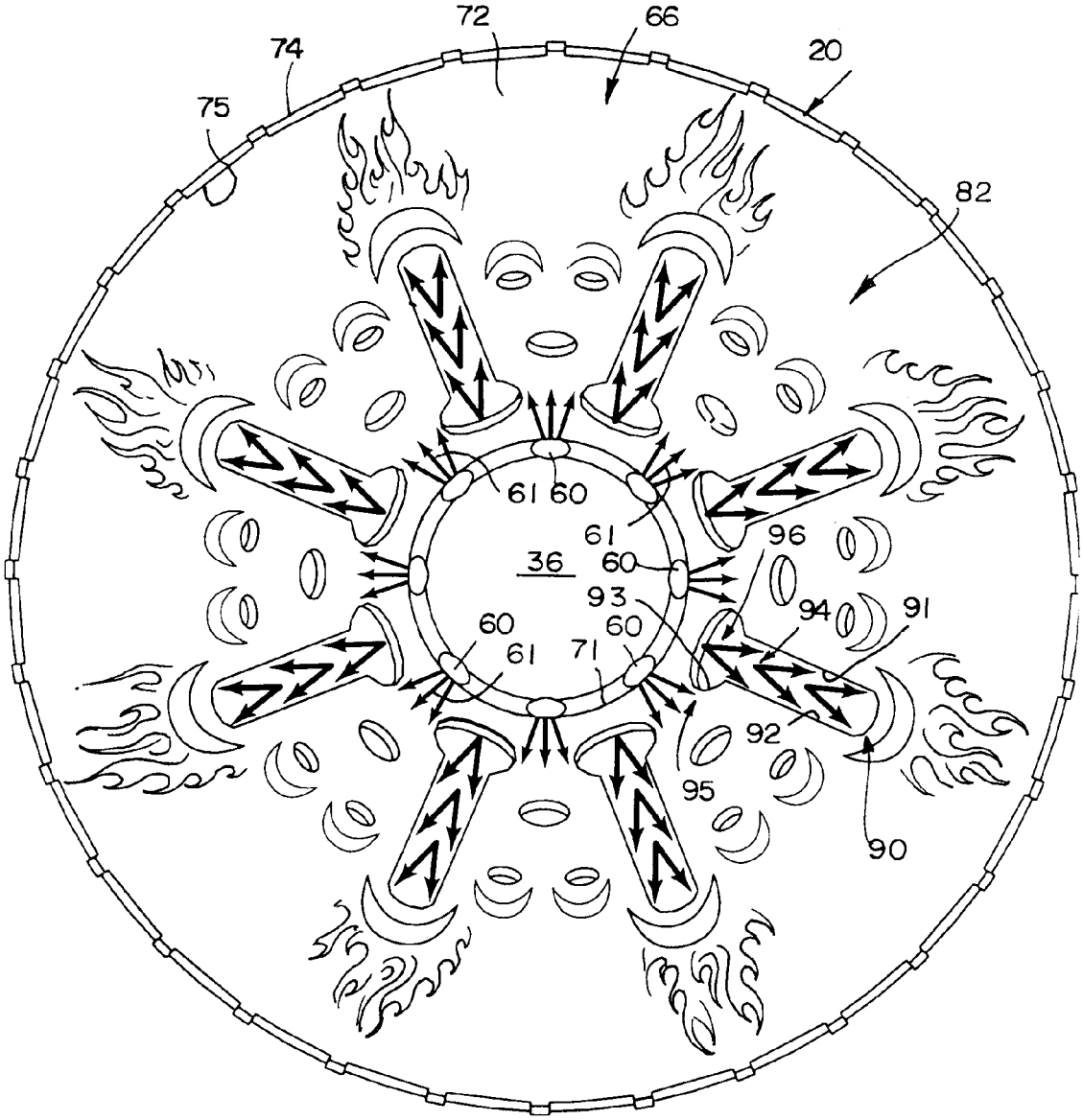
FIG. 7 is an elevation view similar to FIGS. 5 and 6 diagrammatically showing "crescent-shaped" flame attachment regions on the interior surface of the cone during "high-fire" conditions.

As suggested in FIGS. 1 and 4, fuel nozzle 36 includes a shell 56 having an outer end 58 formed to include several circumferentially spaced-apart fuel-discharge ports 60. Shell 56 also is formed to include a fuel-transport passageway 62 arranged to communicate fuel from fuel supply conduit 38 to fuel-discharge ports 60 to cause a stream 61 of fuel (see FIGS. 2 and 5-7) to be discharged from fuel-transport passageway 62 through each of fuel-discharge ports 60 into a mixing chamber 66 formed in air-fuel mixing cone 20. In the illustrated embodiment, a base 57 of shell 56 is coupled to burner housing 18 and most of fuel nozzle 36 is arranged to lie in air plenum chamber 28 as suggested in FIG. 1.

Mixing means 21 is provided for mixing the streams 61 of fuel discharged through fuel-discharge ports 60 formed in fuel nozzle 36 with primary (combustion) air 31 taken from combustion air 30 extant in air plenum 26 associated with fuel nozzle 36 to produce an air-and-fuel mixture 100 that can be ignited in mixing chamber 66 to produce a flame (not shown) as suggested in FIG. 1. Mixing means 21 comprises air-fuel mixing cone 20 and cone support mount 52. As suggested in FIGS. 2 and 3, air-fuel mixing cone 20 is formed to include an inner end 70 defining an upstream nozzle-receiver opening 71, an outer end 74 defining a downstream combustion-discharge opening 75, and a funnel-shaped side wall 72 extending between inner and outer ends 70, 74 to define mixing chamber 66 therebetween. Fuel nozzle 36 is arranged to communicate with mixing chamber 66 via upstream nozzle-receiver opening 71 to discharge streams 61 of fuel into mixing chamber 66.

Figure 2:
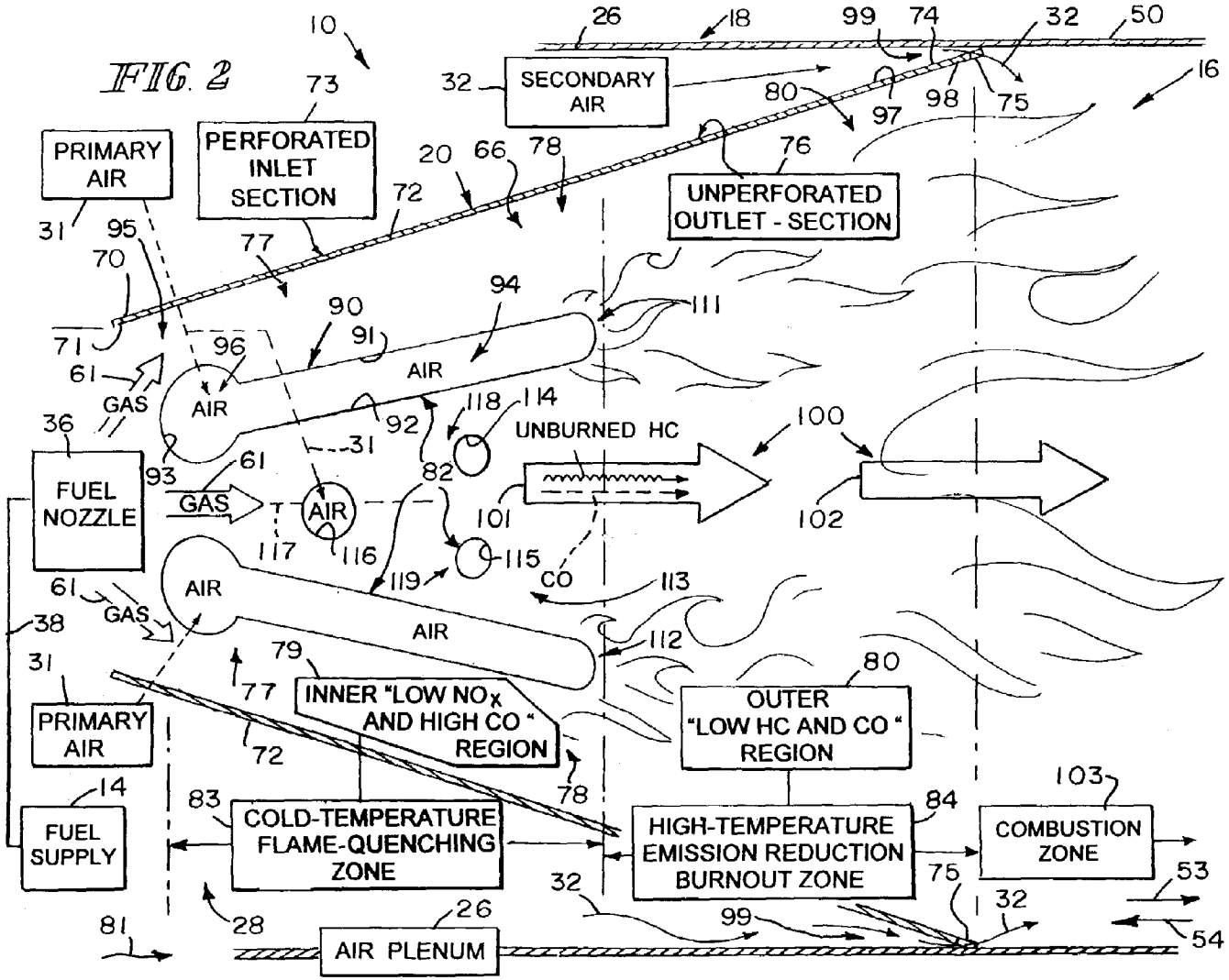
FIG. 2 is a schematic diagram of the air-fuel mixing cone and fuel nozzle of FIG. 1 located in an air plenum formed in the burner housing showing, in series, from left to right, formation of (1) an upstream cold-temperature flame-quenching zone arranged to extend from the fuel nozzle in a "downstream" direction, located in the perforated inlet section of the air-fuel mixing cone, and supplied with primary (combustion) air via an air-admission portal comprising air-admission ports and slots formed in the perforated inlet section, (2) a downstream high-temperature emission-reduction burnout zone located in an unperforated outlet section of the air-fuel mixing cone and not supplied with any combustion air, and (3) a downstream combustion zone arranged to lie outside the air-fuel mixing cone and communicate with an outer end of the air-fuel mixing cone, located in a cylindrical burner discharge sleeve included in the burner housing and supplied with secondary (combustion) air discharged through an annular space formed between a large-diameter outer rim defining the outer end of the air-fuel mixing cone and a surrounding portion of the cylindrical burner discharge sleeve.

As suggested in FIGS. 2 and 4, funnel-shaped side wall 72 of air-fuel mixing cone 20 includes a perforated inlet section 73 and an unperforated outlet section 76. Perforated inlet section 73 extends from upstream nozzle-receiver opening 71 to unperforated outlet section 76. Unperforated outlet section 76 terminates at downstream combustion-discharge opening 75 and defines an outer region 80 of mixing chamber 66. Perforated inlet section 76 is formed to include an upstream territory 77 located adjacent to fuel nozzle 36 and a downstream territory 78 interposed between upstream territory 77 and unperforated outlet section 76. Downstream territory 78 is arranged to cooperate with upstream territory 77 to define an inner region 79 of mixing chamber 66 as suggested diagrammatically in FIG. 2 and illustratively in FIG. 4.

As suggested in FIGS. 1-4, perforated inlet section 73 of funnel-shaped side wall 72 is formed to include air-admission port means for defining an air-admission portal 82 exposed to pressurized air 30 extant in air plenum chamber 28 of air plenum 26. Air-admission portal 82 is configured to extend away from upstream nozzle-receiver opening 71. In illustrative embodiments, air-admission portal 82 comprises slots, apertures, or both formed in funnel-shaped side wall 72 of air-fuel mixing cone 20.

Air-admission portal 82 (i.e., total open area of all of the slots and/or apertures cooperating to define air-admission portal 82) is configured to decrease in effective size along a length of funnel-shaped side wall 66 as distance from upstream nozzle-receiver opening 71 increases in direction 81 as suggested, for example, in FIGS. 1-4. This progressively smaller effective size causes a greater volume of pressurized air 31 to pass through an upstream portion of air-admission portal 82 into upstream territory 77 of inner region 79 of mixing chamber 66 in close proximity to fuel nozzle 36 to mix with the streams 61 of fuel discharged by fuel nozzle 36 to produce a combustible fuel-rich air-and-fuel mixture in upstream territory 77. This progressively smaller effective size of air-admission portal 82 also causes a relatively smaller lesser volume of pressurized air 31 to pass through a downstream portion of air-admission portal 82 into downstream territory 78 of inner region 79 of mixing chamber 66 to generate a first-stage air-and-fuel mixture 101 in downstream territory 78. First-stage air-and-fuel mixture 101 is characterized by a low nitrogen oxide (NOx) content, a high hydrocarbon (HC) content, and a high carbon monoxide (CO) content so that a cold-temperature flame-quenching zone 83 is established in inner region 79 of mixing chamber 66 and carbon monoxide and unburned hydrocarbon included in first-stage air-and-fuel mixture 101 flow from inner region 79 of mixing chamber 66 into outer region 80 of mixing chamber 66 formed in unperforated outlet section 76.

Unperforated outlet section 76 of funnel-shaped side wall 72 is separated from air plenum 26 to block admission of pressurized air 30 from air plenum 26 into outer region 80 of mixing chamber 66 to establish a high-temperature emission-reduction burnout zone 84 in outer region 80 of mixing chamber 66 causing carbon monoxide and hydrocarbon admitted into outer region 80 to be burned therein to generate in outer region 80 of mixing chamber 66 a second-stage air-and-fuel mixture 102 as suggested in FIG. 2. Second-stage air-and-fuel mixture 102 is characterized by a relatively low nitrogen oxide content, a relatively low hydrocarbon content, and a relatively low carbon monoxide content and is discharged from outer region 80 of mixing chamber 66 through combustion-discharge opening 75 formed in outer end 74 of air-fuel mixing cone 20.

Air-admission portal 82 comprises a series of air-admission slots 90 formed in perforated inlet section 73 of funnel-shaped side wall 72 of air-fuel mixing cone 20. Each of the air-admission slots 90 is arranged to extend in a downstream direction 81 along a portion of the length of funnel-shaped side wall 72. Each of air-admission slots 90 is characterized by a lateral width that varies along a length of the slot and widens in places closer to inner end 71 of air-fuel mixing cone 20.

Each air-admission slot 90 is defined by first and second flame-anchor edges 91, 92 and a concave curved edge 93 having a first end coupled to first flame-anchor edge 91 and a second end coupled to second flame-anchor edge 92 as suggested in FIGS. 2 and 4. First and second flame-anchor edges 91, 92 are arranged to lie in spaced-apart relation to one another to define a downstream air-transferring channel 94 therebetween. Concave curved edge 93 is located in a space 95 provided between the first and second flame-anchor edges 91, 92 and upstream nozzle-receiving opening 71 of inner end 70 of air-fuel mixing cone 20 to define an upstream air-transferring aperture 96 communicating with downstream air-transferring channel 94.

Figure 3:
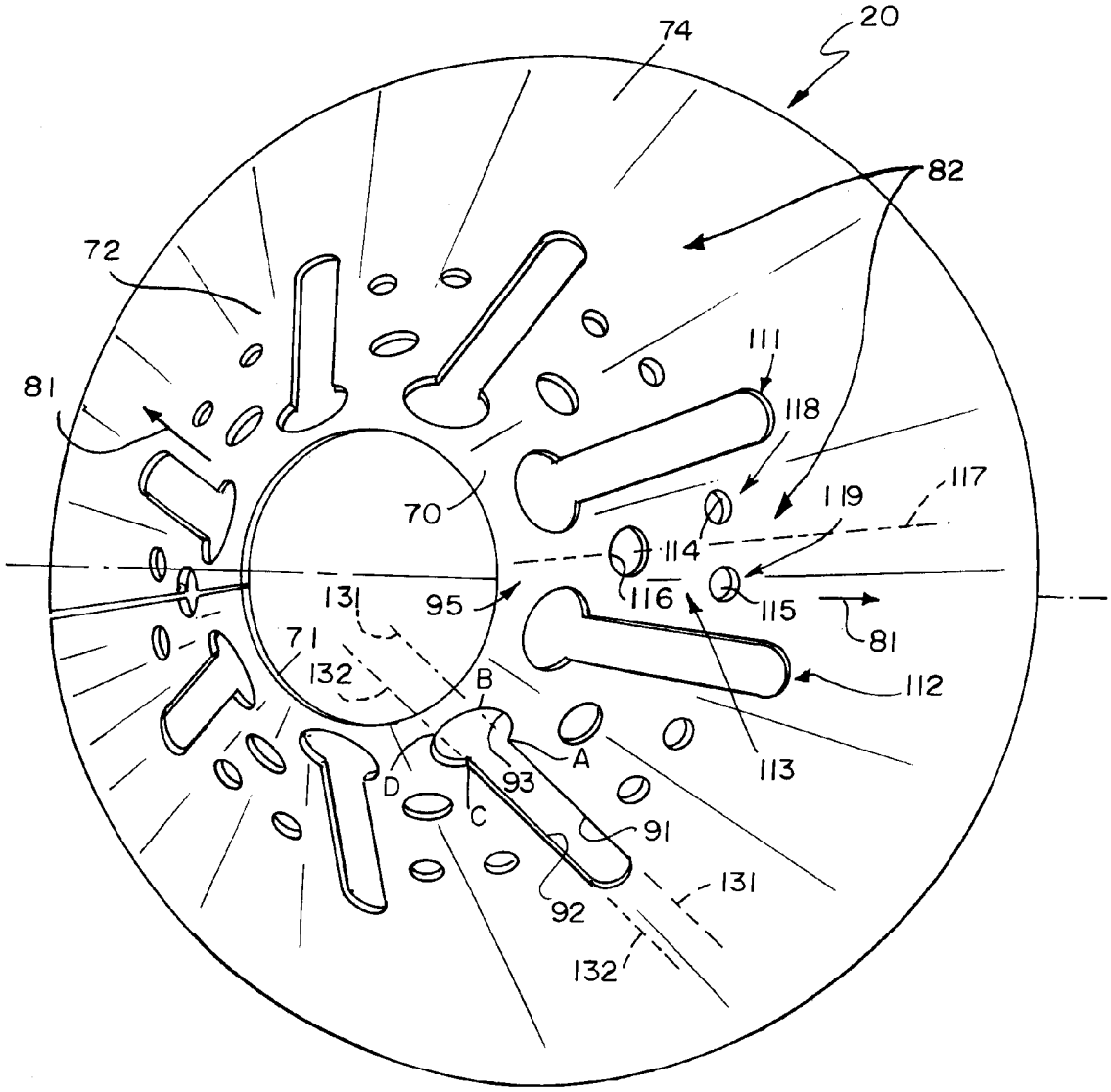
FIG. 3 is an enlarged perspective view of an exterior surface of a funnel-shaped side wall included in the air-fuel mixing cone of FIG. 1 showing formation, in the perforated inlet section of the cone, of an air-admission portal comprising eight spaced-apart air-admission slots (each air-admission slot being characterized by a relatively larger sized inner opening located near a circular upstream nozzle-receiver opening formed in the narrow-diameter inner end of the cone) and of eight spaced-apart sets of air-admission ports and showing that the air-admission ports are progressively reduced in size as they are located further away from the circular nozzle-receiver opening formed in the narrow-diameter inner end of the cone and that there are no air-admission slots or ports in the relatively wider unperforated outlet section of the cone.

First and second flame-anchor edges 91, 92 are separated by a uniform width dimension and concave curved edge 93 is defined by an arcuate section of a circle having a diameter that is greater than the uniform width dimension provided between first and second flame-anchor edges 91, 92 as suggested in FIGS. 2-4. Each of first and second flame-anchor edges 91, 92 has a length that is about 3.5 times the diameter of the circle described above. Concave curved edge 93 is arranged to intersect in two places (A and B) a first reference line 131 coincident with first flame-anchor edge 91 and to intersect in two places (C and D) a second reference line 132 coincident with second flame-anchor edge 92 as suggested in FIG. 3. Concave curved edge 93 circumscribes an arc of about 300 degrees and in illustrative embodiments, an arc within a range of about 250-320 degrees As suggested in FIG. 1, burner housing 18 includes an interior region comprising at least air-conducting passageway 25 in air duct 22, air plenum chamber 28 in air plenum 26, and the interior region provided in burner discharge sleeve 50. Air-fuel mixing cone 20 is located in the interior region of burner housing 18 to expose air-admission portal 82 to primary (combustion) air 31 derived from combustion air 30 extant in air plenum chamber 28 of air plenum 26. As suggested in FIGS. 1 and 2, funnel-shaped side wall 72 of air-fuel mixing cone 20 includes an exterior surface 97 that terminates at a large-diameter outer rim 98 and cooperates with a surrounding wall included, for example, in burner discharge sleeve 50 included in burner housing 18 to define means for diverting pressurized combustion air 30 from air plenum 26 to generate a stream of secondary (combustion) air 32 flowing past unperforated outlet section 76 of funnel-shaped side wall 72 to cool funnel-shaped side wall 72 of air-fuel mixing cone 20 and flowing through a secondary air channel 99 defined between large-diameter outer rim 98 and surrounding wall 50 into a combustion zone 103. Combustion zone 103 is provided in burner housing 18 and arranged also to receive second-stage air-and-fuel mixture 102 discharged from outer region 80 of mixing chamber 66 through combustion-discharge opening 75 formed in outer end 74 of air-fuel mixing cone 20.

Air-admission portal 82 is sized to provide primary air means for admitting from air plenum chamber 28 of air plenum 26 about 80 to 90 percent of combustion air needed for combustion into mixing chamber 66 in illustrative embodiments of the present disclosure. Secondary air channel 99 defined between large-diameter outer rim 98 and surrounding wall 50 is sized to provide secondary air means for admitting from air plenum chamber 28 of air plenum 26 about 10 to 20 percent of combustion air needed for combustion in combustion zone 103 also in illustrative embodiments of the present disclosure.

As suggested diagrammatically in FIG. 2, air-admission portal 82 comprises first and second air-admission slots 111, 112 formed in perforated inlet section 73 of funnel-shaped side wall 72 and arranged to lie in spaced-apart relation to one another to define a field 113 located therebetween. A first small-size air-admission port 114 is formed in field 113 in perforated inlet section 73 of funnel-shaped side wall 72 and located in spaced-apart relation to upstream nozzle-receiving opening 71 and characterized by a first open-area size. A large-size air admission port 116 is formed in field 113 to lie between upstream nozzle-receiving opening 71 and first small-size air-admission port 114 and characterized by a second open-area size that is greater than the first open-area size. Air-admission portal 82 further comprises a second small-size air-admission port 115 formed in field 113 and located between first small-size air-admission port 114 and first air-admission slot 111. Second small-size air-admission port 115 is characterized by the first open-area size. It is within the scope of this disclosure to provide air-admission ports in varying numbers, shapes, patterns, and locations in field 113.

As suggested in FIG. 2, each of the air-admission slots 111, 112 is arranged to extend in a downstream direction along a portion of the length of funnel-shaped side wall 72. Each of air-admission slots 111, 112 is characterized by a lateral width that varies along a length of the slot and widens in places closer to inner end 71 of air-fuel mixing cone 20. Air-admission ports 116, 115, 114 are progressively reduced in size as distance away from upstream nozzle-receiving opening 71 increases in direction 81 as suggested in FIG. 2.

As suggested in FIG. 2, an upstream air-admission port 116 is formed in field 113 along a bifurcation reference line 117 that is arranged to bifurcate field 113 to define a first field section 118 between first air-admission slot 111 and bifurcation reference line 117 and a second field section 119 between second air-admission slot 112 and bifurcation reference line 117. First downstream air-admission port 114 is formed in first field section 118 to locate upstream air-admission port 116 between first downstream air-admission port 114 and upstream nozzle-receiving opening 71. Second downstream air-admission port 115 is formed in second field section 119 to locate upstream air-admission port 116 between second downstream air-admission port 115 and upstream nozzle-receiving opening 71. One of the fuel-discharge ports 60 is oriented to discharge a stream 61 of fuel into upstream territory 77 of mixing chamber 66 along bifurcation reference line 117 as suggested in FIG. 2. Upstream air-admission port 116 provides an opening of a first size and each of the first and second downstream air-admission ports 114, 115 provides an opening of a relatively smaller second size as suggested in FIG. 2.

An air-mixing cone 220 in accordance with a second embodiment of the present disclosure is shown, for example, in FIGS. 9 and 10. Air-fuel mixing cone 220 is formed to include an inner end 270 defining an upstream nozzle-receiver opening 271, an outer end 274 defining a downstream combustion-discharge opening 275, and a funnel-shaped side wall 272 extending between inner and outer ends 270, 274 to define mixing chamber 266 therebetween. Fuel nozzle 36 is arranged to communicate with mixing chamber 266 via upstream nozzle-receiver opening 271 to discharge streams of fuel into mixing chamber 266.

Air-mixing cone 220 is formed to include an air-admission portal 282 comprising only a series of spaced-apart air-admission slots 290 as shown, for example, in FIGS. 9 and 10. It is, however, within the scope of the present disclosure to form air-mixing cone 220 to include air-admission ports or other openings in the fields 213 between adjacent air-admission slots 290.

An air-mixing cone 320 in accordance with a third embodiment of the present disclosure is shown, for example, in FIGS. 11 and 12. Air-fuel mixing cone 320 is formed to include an inner end 370 defining an upstream nozzle-receiver opening 371, an outer end 374 defining a downstream combustion-discharge opening 375, and a funnel-shaped side wall 372 extending between inner and outer ends 370, 374 to define mixing chamber 366 therebetween. Fuel nozzle 36 is arranged to communicate with mixing chamber 366 via upstream nozzle-receiver opening 371 to discharge streams of fuel into mixing chamber 366.

Air-mixing cone 320 is formed to include an air-admission portal 382 comprising only a series of spaced-apart air-admission slots 390 as shown, for example, in FIGS. 11 and 12. It is, however, within the scope of the present disclosure to form air-mixing cone 320 to include air-admission ports or other openings in the fields 313 between adjacent air-admission slots 390.

As suggested in the embodiment of FIGS. 11 and 12, first and second flame-anchor edges 391, 391 are arranged to diverge in an upstream direction toward a concave curved edge 313. This arrangement causes the air-admission slot 390 bounded by the first and second flame-anchor edges 391, 392 to have a lateral width that narrows as distance away from concave curved edge 393 increases. Each air-admission slot 390 is also bounded by a concave curved edge 393 located between the upstream nozzle-receiving opening 371 and the first and second flame-anchor edges 391, 392 and arranged to interconnect upstream ends of first and second flame-anchor edges 391, 392. Concave curved edge 393 is arranged to lie wholly in a space provided between a first reference line coincident with first flame-anchor edge 391 and a second reference line coincident with second flame-anchor edge 392.

An air-mixing cone 420 in accordance with a fourth embodiment of the present disclosure is shown, for example, in FIGS. 13 and 14. Air-fuel mixing cone 420 is formed to include an inner end 470 defining an upstream nozzle-receiver opening 471, an outer end 474 defining a downstream combustion-discharge opening 475, and a funnel-shaped side wall 472 extending between inner and outer ends 470, 474 to define mixing chamber 466 therebetween. Fuel nozzle 36 is arranged to communicate with mixing chamber 466 via upstream nozzle-receiver opening 471 to discharge streams of fuel into mixing chamber 466.

Air-mixing cone 420 is formed to include an air-admission portal 482 comprising only a series of spaced-apart air-admission slots 490 as shown, for example, in FIGS. 13 and 14. It is, however, within the scope of the present disclosure to form air-mixing cone 420 to include air-admission ports or other openings in the fields 413 between adjacent air-admission slots 490.

As suggested in the embodiment of FIGS. 13 and 14, each first and second flame-anchor edge 491, 492 includes an upstream end located in close proximity to the upstream nozzle-receiving opening 471 and an opposite downstream end located between a companion upstream end and downstream combustion-discharge opening 475 formed in outer end 474 of air-fuel mixing cone 420. First and second flame-anchor edges 491, 492 intersect at the downstream ends thereof at point 495. Each air-admission slot 490 is also bounded by an interior edge 493 formed in funnel-shaped side wall 420 and arranged to interconnect the upstream ends of first and second flame-anchor edges 491, 492. In the illustrated embodiment, each of edges 491, 492, 493 are straight and edges 491, 492, 493 cooperate to form an Isosceles triangle.

An air-mixing cone 520 in accordance with a fifth embodiment of the present disclosure is shown, for example, in FIGS. 15 and 16. Air-fuel mixing cone 520 is formed to include an inner end 570 defining an upstream nozzle-receiver opening 571, an outer end 574 defining a downstream combustion-discharge opening 575, and a funnel-shaped side wall 572 extending between inner and outer ends 570, 574 to define mixing chamber 566 therebetween. Fuel nozzle 36 is arranged to communicate with mixing chamber 566 via upstream nozzle-receiver opening 571 to discharge streams of fuel into mixing chamber 566.

Air-mixing cone 520 is formed to include an air-admission portal 582 comprising only a series of spaced-apart air-admission slots 590 as shown, for example, in FIGS. 15 and 16. It is, however, within the scope of the present disclosure to form air-mixing cone 520 to include air-admission ports or other openings in the fields 513 between adjacent air-admission slots 590. As suggested in the embodiment of FIGS. 15 and 16, each of first and second flame anchor edges 591, 592 intersects a narrow-diameter inner rim 570 defining upstream nozzle-receiving opening 571.

The design of mixing cones 20, 220, 320, 420, and 520 in accordance with the present disclosure allows for mid to low emission performance without sacrificing burner turndown. The burner emissions can be controlled and regulated easily by simply increasing or decreasing excess air. Air-fuel mixing cones 20, 220, 320, 420, and 520 can be scaled easily to a larger or smaller burner while maintaining same flame characteristics and emission performance. Each air-fuel mixing cone is made out of stainless steel material and provided with holes or slots. The slots are sized for an optimal open area through which air passes and enters the cone. The cone is located inside of a burner discharge sleeve 50 and is mounted on a fuel nozzle 36.

The fuel nozzle 36 delivers fuel into the air-fuel mixing cone and injects fuel 61 between the air-opening slots 90, 290, 390, 490, or 590. The slots are sized and shaped to allow for the largest volume of air to enter the cone next to fuel nozzle 36 at the throat of the cone and are smaller as the cone opens. The cone openings extend to only half of the cone length. The remaining portion of the cone without openings serves as a protective zone.

The reason for the opening size and shape is to provide flame with a cold-temperature flame-quenching zone 83 where the flame temperature is minimized, thus reducing the emission of thermal NOx. The latter part of the cone without the openings exists to burn out the CO created by the quenched flame in the first zone of the cone.

The shape and size of the openings are defined to allow for maximum volume of air near fuel nozzle 36 without sacrificing flame stability. The fuel 61 is injected between the cone openings at the same or slightly larger angle as the cone, allowing the fuel jet to flow parallel to the cone area between the openings and to progressively mix with air. This enhances the fuel-air mixing, as well as provides an anchor for the flame at low-fire conditions.

The area in fields 113, 213, 313, 413, and 513 between the slots provides a retention zone where the flame can stabilize near the fuel nozzle and is not directly in the air stream. At mid-to-high fire conditions, the area between the slots offers a medium for gas to progressively mix with air and to penetrate deeper into the cone. The negative pressure around the edge of the slots, produced by the air stream entering the cone, creates an eddy effect which enhances the mixing of fuel 61 and air 31. The eddy effect not only helps in mixing of fuel and air, but also creates an effective anchor where flame can establish. Depending on the intensity of the air stream, the flame anchor can either encompass the entire circumference of the slot opening or can shift and move to the end of the slot opening.

At high-fire conditions the intensity of air stream moves the flame to the end of the slots and anchors the flame in the base of the cone protective zone 84 defined by unperforated outlet section 76. In the protective zone 84, the velocity of the air stream greatly decelerates, allowing the flame to establish and to float with minimum flame retention. The flame is still anchored to the slot openings. However, a majority of the flame is lifted and burns almost as a premixed flame. The anchored flame serves as a supply of ignition for the main flame. As the base of the flame shifts and moves away from the gas nozzle, the fuel and air are partly mixed before burning. The openings (e.g., air-admission ports 114, 115, 116) between the slots provide additional means to quench the flame by injecting air into the base of the flame and also a way to split the fuel and force it to mix with the air flowing form the slots.

Nearly all of the combustion air (80 to 90 percent) enters the air-fuel mixing cone throughout the slots and holes at the base of the cone. The rest of the air is directed around the cone and enters combustion zone 103 outside of the cone as secondary air 32. The secondary air 32 around the cone is used to cool the cone and to provide additional and final flame quenching. The amount of secondary air 32 is controlled by the gap 99 provided between the cone and a discharge sleeve in which the cone is located.

The slots/openings are sized and shaped to allow the largest volume of air to enter the cone adjacent to the nozzle at the base of the cone and are smaller as the cone opens. The cone opening lengths are sized to extend half of the cone length. The remaining portion of the cone without openings serves as a protective burnout zone 84. One reason for the opening size and shape is to provide flame with a cold temperature flame-quenching zone 83 where the flame temperature is minimized, thus reducing the emission of thermal NOx. The later part of the cone without the openings allows for burnout of the remaining CO created in the quenched first zone 83 of the cone. The shape of the openings allows for minimum flame retention without sacrificing flame stability.

Figure 8:
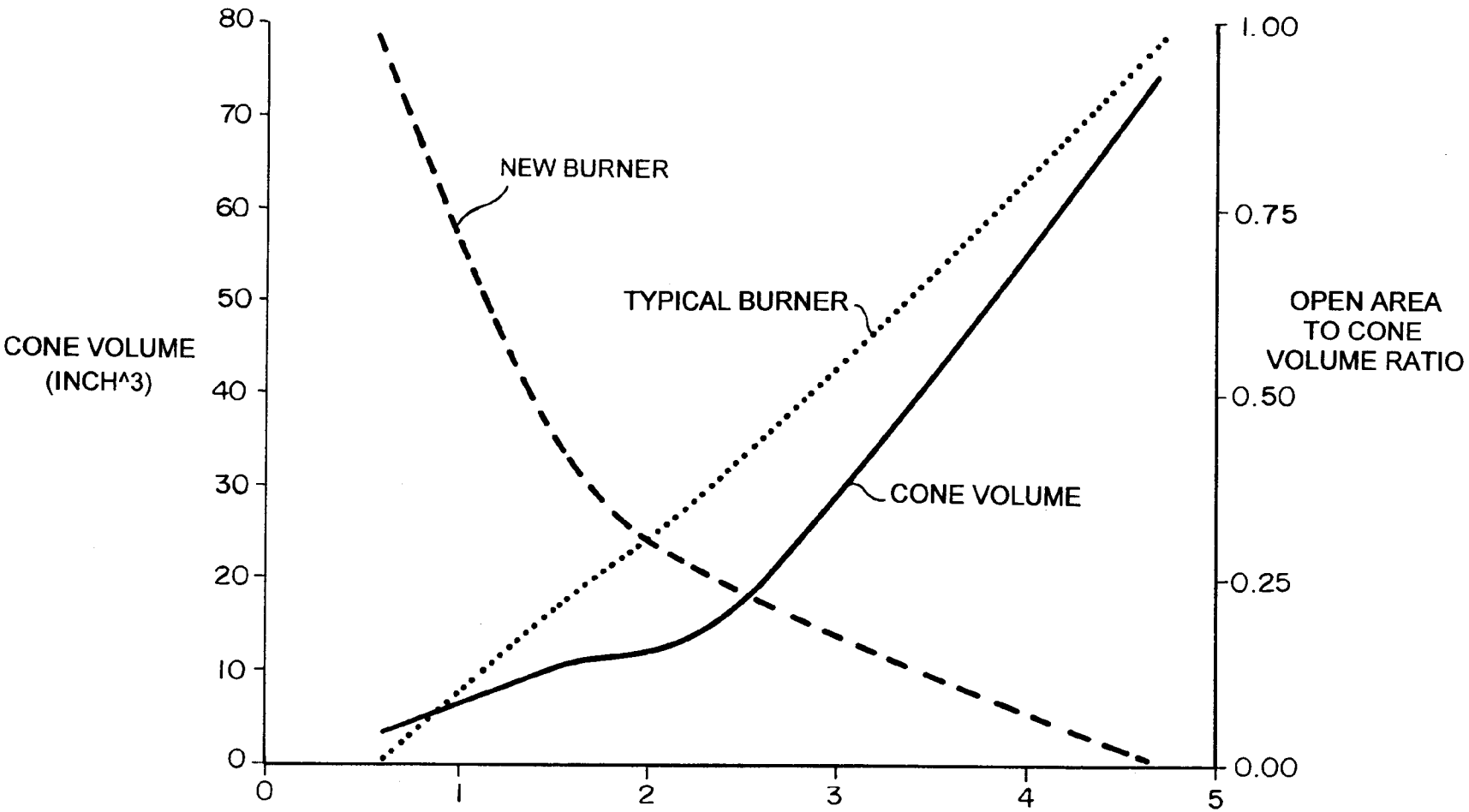
FIG. 8 is a graph showing that the effective size of the "openings" in the air-fuel mixing cone made in accordance with the present disclosure and defined by the air-admission slots and ports decreases as (1) the volume of the cone increases and (2) the distance from the fuel nozzle increases in marked contrast to an increasing effective size of openings provided in a "typical" air-fuel burner.

A graph illustrated in FIG. 8 shows that the effective size of the combustion air "openings" in an air-fuel mixing cone 20 made in accordance with the present disclosure and defined, e.g., by air-admission slots 90 and ports 115, 116 decreases as (1) the volume of cone 20 increases and (2) the distance from fuel nozzle 36 increases. This is in marked contrast to an increasing effective size of combustion air openings provided in a "typical" air-fuel burner.

The traditional approach is to use cones or mixing plates and to create a combustion zone within these plates. Cones or mixing plates typically use openings that are smaller at the base of the cone next to the fuel nozzle and become progressively larger as they move upward in the cone. The combustion air openings can be round with the smallest openings first and the largest last. If slots are utilized, then their orientation is also in the same fashion. They are small at the base next to the fuel nozzle and are progressively larger.

One reason for this difference is a fundamentally different approach to the emissions control and to the burner turndown. The prior burners were either designed for a constant airflow or for high turndown performance only, without the emphasis on burner emissions. The reason for the traditional layout of the openings is to allow minimum amount of air at the base of the flame next to the gas nozzle and maximum after the flame develops and is established. The opening size was progressively larger and sized according to the combustion zone volume. At minimum fire where the combustion zone volume is the smallest and where the flame intensity is the weakest, the air openings in the cone were sized to protect this flame and their open area was sized to only supply the air needed for that particular flame rate. The air openings would get progressively larger corresponding to the flame zone intensity. Such design allows for a good flame turndown control. However, it does not allow for NOx or CO emission control.

The slots/openings provided in air-fuel mixing conies in accordance with the present disclosure are sized and shaped to allow the largest volume of air to enter the cone next to the nozzle at the base of the cone and are smaller as the cone opens. The cone openings take up only half of the cone length. The remaining portion of the cone without openings serves as a protective zone. The reason for the opening size and shape is to provide flame with a cold-quenching zone, thus minimizing the flame temperature and reducing the emission of NOx. The later part of the cone without the openings allows for burnout of the unburned hydrocarbons and Co created in the quenched first zone of the cone. The opening shape allows for minimum flame retention without sacrificing flame stability. The cone openings are sized to allow 80 to 90 percent of air to enter the combustion zone at the base of the flame where the fuel is introduced. This approach allows emission control without sacrificing burner turndown or flame stability. Such opening and spacing are contrary to the traditional approach where a cone or mixing plates are used to create a combustion zone.

The invention claimed is:

1. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to only pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, and wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone.

2. The burner assembly of claim 1, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone.

3. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone, and wherein at least one of the air-admission slots is defined by first and second flame-anchor edges and a concave curved edge having a first end coupled to the first flame-anchor edge and a second end coupled to the second flame-anchor edge, the first and second flame-anchor edges are arranged to lie in spaced-apart relation to one another to define a downstream air-transferring channel therebetween, and the concave curved edge is located in a space between the first and second flame-anchor edges and the upstream nozzle-receiving opening of the inner end of the air-fuel mixing cone to define an upstream air-transferring aperture communicating with the downstream air-transferring channel.

4. The burner assembly of claim 3, wherein the first and second flame-anchor edges are separated by a uniform width dimension and the concave curved edge is defined by an arcuate section of a circle having a diameter that is greater than the uniform width dimension provided between the first and second flame-anchor edges.

5. The burner assembly of claim 4, wherein each of the first and second flame-anchor edges has a length that is about 3.5 times said diameter.

6. The burner assembly of claim 3, wherein the concave curved edge is arranged to intersect in two places a first reference line coincident with the first flame-anchor edge and to intersect in two places a second reference line coincident with the second flame-anchor edge.

7. The burner assembly of claim 3, wherein the concave curved edge circumscribes an arc of about 250 to 320 degrees.

8. The burner assembly of claim 3, wherein the first and second flame-anchor edges are arranged to diverge in an upstream direction toward the concave curved edge to cause the air-admission slot bounded by the first and second flame-anchor edges to have a lateral width that narrows as distance away from the concave curved edge increases.

9. The burner assembly of claim 7, wherein the concave curved edge is arranged to lie wholly in a space provided between a first reference line coincident with the first flame-anchor edge and a second reference line coincident with the second flame-anchor edge.

10. The burner assembly of claim 2, wherein at least one of the air-admission slots is bounded by first and second flame-anchor edges that are formed in the funnel-shaped side wall and arranged to converge in a downstream direction away from the upstream nozzle-receiving opening formed in the air-fuel mixing cone to cause the air-admission slot bounded by the first and second flame-anchor edges to have a lateral width that narrows as distance away from the upstream nozzle-receiving opening increases.

11. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone, wherein at least one of the air-admission slots is bounded by first and second flame-anchor edges that are formed in the funnel-shaped side wall and arranged to converge in a downstream direction away from the upstream nozzle-receiving opening formed in the air-fuel mixing cone to cause the air-admission slot bounded by the first and second flame-anchor edges to have a lateral width that narrows as distance away from the upstream nozzle-receiving opening increases, and wherein the at least one of the air-admission slots is also bounded by a concave curved edge located between the upstream nozzle-receiving opening and the first and second flame-anchor edges and arranged to interconnect upstream ends of the first and second flame-anchor edges.

12. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone, wherein at least one of the air-admission slots is bounded by first and second flame-anchor edges that are formed in the funnel-shaped side wall and arranged to converge in a downstream direction away from the upstream nozzle-receiving opening formed in the air-fuel mixing cone to cause the air-admission slot bounded by the first and second flame-anchor edges to have a lateral width that narrows as distance away from the upstream nozzle-receiving opening increases, and wherein each of the first and second flame-anchor edges includes an upstream end located in close proximity to the upstream nozzle-receiving opening and an opposite downstream end located between a companion upstream end and the downstream combustion-discharge opening formed in the outer end of the air-fuel mixing cone, the first and second flame-anchor edges intersect at the downstream ends thereof, and the at least one of the air-admission slots is also bounded by an interior edge formed in the funnel-shaped side wall and arranged to interconnect the upstream ends of the first and second flame-anchor edges.

13. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone, wherein at least one of the air-admission slots is bounded by first and second flame-anchor edges that are formed in the funnel-shaped side wall and arranged to converge in a downstream direction away from the upstream nozzle-receiving opening formed in the air-fuel mixing cone to cause the air-admission slot bounded by the first and second flame-anchor edges to have a lateral width that narrows as distance away from the upstream nozzle-receiving opening increases, and wherein each of the first and second flame anchor edges intersects a narrow-diameter inner rim defining the upstream nozzle-receiving opening.

14. The burner assembly of claim 1, further comprising a burner housing including an interior region and wherein the air-fuel mixing cone is located in the interior region to expose the air-admission portal to primary combustion air extant in the air plenum and wherein the funnel-shaped side wall of the air-fuel mixing cone includes an exterior surface that terminates at a large-diameter outer rim and cooperates with a surrounding wall included in the burner housing to define means for diverting pressurized combustion air from the air plenum to generate a stream of secondary combustion air flowing past the unperforated outlet section of the funnel-shaped side wall to cool the funnel-shaped side wall of the air-fuel mixing cone and flowing through a secondary air channel defined between the large-diameter outer rim and the surrounding wall into a combustion zone provided in the burner housing and arranged also to receive the second-stage air-and-fuel mixture discharged from the outer region of the mixing chamber through the combustion-discharge opening formed in the outer end of the air-fuel mixing cone.

15. A burner assembly for combining air and fuel to produce a flame, the burner assembly comprising a fuel nozzle including a shell formed to include several fuel-discharge ports and a fuel-transport passageway arranged to communicate fuel to the fuel-discharge ports to cause a stream of fuel to be discharged from the fuel-transport passageway through each of the fuel-discharge ports and mixing means for mixing the streams of fuel discharged through the fuel-discharge ports formed in the fuel nozzle with combustion air extant in an air plenum associated with the fuel nozzle to produce an air-and-fuel mixture that can be ignited in a mixing chamber to produce a flame, wherein the mixing means includes an air-fuel mixing cone formed to include an inner end defining an upstream nozzle-receiver opening, an outer end defining a downstream combustion-discharge opening, and a funnel-shaped side wall extending between the inner and outer ends to define a mixing chamber therebetween, the fuel nozzle is arranged to communicate with the mixing chamber via the upstream nozzle-receiver opening to discharge streams of fuel into the mixing chamber, and the funnel-shaped side wall includes an unperforated outlet section terminating at the downstream combustion-discharge opening and defining an outer region of the mixing chamber and a perforated inlet section extending from the upstream nozzle-receiver opening to the unperforated outlet section and having an upstream territory located adjacent to the fuel nozzle and a downstream territory interposed between the upstream territory and the unperforated outlet section and arranged to cooperate with the upstream territory to define an inner region of the mixing chamber, wherein the perforated inlet section of the funnel-shaped side wall is formed to include air-admission port means for defining an air-admission portal exposed to pressurized air extant in the air plenum and configured to extend away from the upstream nozzle-receiver opening and to decrease in effective size along a length of the funnel-shaped side wall as distance from the upstream nozzle-receiver opening increases to cause a greater volume of pressurized air to pass through an upstream portion of the air-admission portal into the upstream territory of the inner region of the mixing chamber in close proximity to the fuel nozzle to mix with the streams of fuel discharged by the fuel nozzle to produce a combustible fuel-rich air-and-fuel mixture in the upstream territory and to cause a relatively smaller lesser volume of pressurized air to pass through a downstream portion of the air-admission portal into the downstream territory of the inner region of the mixing chamber to generate in the downstream territory a first-stage air-and-fuel mixture characterized by a low nitrogen oxide (NOx) content, a high hydrocarbon (HC) content, and a high carbon monoxide (CO) content so that a cold-temperature flame-quenching zone is established in the inner region of the mixing chamber and carbon monoxide, unburned hydrocarbon included in the first-stage air-and-fuel mixture flow from the inner region of the mixing chamber into the outer region of the mixing chamber formed in the unperforated outlet section, wherein the unperforated outlet section of the funnel-shaped side wall is separated from the air plenum to block admission of pressurized air from the air plenum into the outer region of the mixing chamber to establish a high-temperature emission-reduction burnout zone in the outer region of the mixing chamber causing carbon monoxide and hydrocarbon admitted into the outer region to be burned therein to generate in the outer region of the mixing chamber a second-stage air-and-fuel mixture characterized by a low nitrogen oxide content, a low hydrocarbon content, and a low carbon monoxide content that is discharged from the outer region of the mixing chamber through the combustion-discharge opening formed in the outer end of the air-fuel mixing cone, and wherein the air-admission portal is sized to provide primary air means for admitting from the air plenum about 80 to 90 percent of combustion air needed for combustion into the mixing chamber and the secondary air channel defined between the large-diameter outer rim and the surrounding wall is sized to provide secondary air means for admitting from the air plenum about 10 to 20 percent of combustion air needed for combustion in the combustion zone.

16. The burner assembly of claim 1, wherein the air-admission portal comprises first and second air-admission slots formed in the perforated inlet section of the funnel-shaped side wall and arranged to lie in spaced-apart relation to one another to define a field therebetween, a first small-size air-admission port formed in the field in the perforated inlet section of the funnel-shaped side wall and located in spaced-apart relation to the upstream nozzle-receiving opening and characterized by a first open-area size and a large-size air-admission port formed in the field of the perforated inlet section of the funnel-shaped side wall to lie between the upstream nozzle-receiving opening and the first small-size air-admission port and characterized by a second open-area size that is greater than the first open-area size.

17. The burner assembly of claim 16, wherein the air-admission portal further comprises a second small-size air-admission port formed in the field of the perforated inlet section of the funnel-shaped side wall and located between the first small-size air-admission port and the first air-admission slot and wherein the second small-size air-admission port is characterized by the first open-area size.

18. The burner assembly of claim 16, wherein the air-admission portal comprises a series of air-admission slots formed in the perforated inlet section of the funnel-shaped side wall of the air-fuel mixing cone, each of the air-admission slots is arranged to extend in a downstream direction along a portion of the length of the funnel-shaped side wall, and each of the air-admission slots is characterized by a lateral width that varies along a length of the slot and widens in places closer to the inner end of the air-fuel mixing cone.

19. The burner assembly of claim 1, wherein the air-admission portal comprises first and second air-admission slots formed in the perforated inlet section of the funnel-shaped side wall and arranged to lie in spaced-apart relation to one another to define a field therebetween and air-admission ports formed in the field and wherein the air-admission ports are progressively reduced in size as distance away from upstream nozzle-receiving opening increases.

20. The burner assembly of claim 1, wherein the air-admission portal comprises first and second air-admission slots formed in the perforated inlet section of the funnel-shaped side wall and arranged to lie in spaced-apart relation to one another to define a field therebetween, an upstream air-admission port formed in the field along a bifurcation reference line bifurcating the field to define a first field section between the first air-admission slot and the reference line and a second field section between the second air-admission slot and the reference line, a first downstream air-admission port formed in the first field section to locate the upstream air-admission port between the first air-admission port and the upstream nozzle-receiving opening, and a second downstream air-admission port formed in the second field section to locate the upstream air-admission port between the second air-admission port and the upstream nozzle-receiving opening and wherein one of the fuel-discharge ports is oriented to discharge a stream of fuel into the upstream territory of the mixing chamber along the bifurcation reference line.

21. The burner assembly of claim 20, wherein the upstream air-admission port provides an opening of a first size and each of the first and second downstream air-admission ports provides an opening of a relatively smaller second size.

* * * * *